US006755255B2

(12) United States Patent
Wade et al.

(10) Patent No.: US 6,755,255 B2
(45) Date of Patent: Jun. 29, 2004

(54) METHOD AND APPARATUS FOR PROVIDING A PORTABLE FLOW LINE AND MEASURING UNIT FOR AN OIL AND/OR GAS WELL

(76) Inventors: Paul E. Wade, 1400 Easton Dr. Suite 113, Bakersfield, CA (US) 93309; Ted C. Witt, P.O. Box 691, Ventura, CA (US) 93002

( * ) Notice: Subject to any disclaimer, the term of this patent is extended or adjusted under 35 U.S.C. 154(b) by 67 days.

(21) Appl. No.: 10/245,885

(22) Filed: Sep. 16, 2002

(65) Prior Publication Data

US 2003/0141054 A1 Jul. 31, 2003

Related U.S. Application Data

(60) Provisional application No. 60/323,250, filed on Sep. 17, 2001.

(51) Int. Cl.[7] ..... E21B 43/34

(52) U.S. Cl. ..... 166/369; 166/75.11; 166/75.12; 166/372; 166/250.15; 137/197; 137/899.4; 210/188

(58) Field of Search ..... 166/267, 75.11, 166/75.12, 369, 372, 250.15; 137/197, 899.4; 210/188

(56) References Cited

U.S. PATENT DOCUMENTS 4,476,923 A * 10/1984 Walling ..... 166/66.4
5,211,842 A * 5/1993 Tuss et al. ..... 210/87
5,900,137 A * 5/1999 Homan ..... 210/85

* cited by examiner

*Primary Examiner*—David Bagnell
*Assistant Examiner*—Giovanna M. Collins
(74) *Attorney, Agent, or Firm*—James M. Duncan

(57) ABSTRACT

The disclosed invention comprises an apparatus and method for producing hydrocarbons from an oil well where no production lines are in place, or where the backpressure of existing production lines is higher than the surface pressure of the oil well, preventing flow of the hydrocarbons into the production lines. The apparatus comprises a production assembly which may be mounted on either a flatbed trailer or on a liftable skid unit. The production assembly comprises a two-phase separator for separating liquid and gas phases. The production assembly further comprises a flexible flowline which is wrapped around a spooling drum. A first end of the flexible flowline receives the fluids from the two-phase separator. The second end of the flexible flowline is attached to a production facility or production line. The production assembly may further comprise pumping and compression means, liquid measurement means and gas measurement means.

25 Claims, 2 Drawing Sheets

METHOD AND APPARATUS FOR PROVIDING A PORTABLE FLOW LINE AND MEASURING UNIT FOR AN OIL AND/OR GAS WELL

CROSS REFERENCE TO RELATED APPLICATION

U.S. Provisional Application No. 60/323,250 was filed for this invention on Sep. 17, 2001 for which the inventor claims domestic priority.

BACKGROUND OF THE INVENTION

The present invention generally relates to methods and devices which are used for the production of oil and natural gas. More specifically, this invention is directed to methods and devices which provide for the temporary production and measurement of multiple-phase fluid streams in the absence, incapacity, or malfunction of permanent flow lines and measuring systems. The disclosed invention may be used where the length of the required temporary flow line is relatively long; for example where the distance between the wellhead and nearest production flow line or inlet to surface facilities is over 1000 feet in length.

The purpose of the present invention is to provide a method and apparatus for the transport and/or measurement of oil and gas from an oil and gas well for a number of different situations the oil and gas operator may face. Included within these situations are the following scenarios:

(1) The production flow lines have been disconnected for a variety of reasons, such as low production from the well or lack of integrity of the flow line.

(2) A gas well has died from loading up with liquids, such that insufficient wellhead pressure exists to produce well fluids into the flow line system.

(3) A new well is ready to be placed on production, but the permanent flow lines between the wellhead and surface facilities have yet to be installed.

(4) The operator desires, for various reasons, to produce fluids from the tubing-casing annulus which fluids the operator desires to measure before placing in the existing surface facilities, or where the operator desires to direct those fluids to a higher pressure system. This situation includes instances where the operator circulates fluids down the tubing string and produces fluids from the tubing-casing annulus.

In the case of idle wells where the flow lines have been disconnected, it is known that oil, gas and other reservoir fluids may gradually accumulate at the wellhead as the pressure within the wellbore approaches static pressure. As the wellbore reaches static pressure, a column of gas, oil, and/or water may build up in the tubing and in the tubing-casing annulus, to where an appreciable volume of hydrocarbons may accumulate at the wellhead at ground surface. Gas expansion may result in these accumulated fluids exerting substantial surface pressures at the wellhead in the tubing-casing annulus. Unless there are readily available production facilities designed for receiving these fluids, recovery of these potentially valuable substances is difficult.

In the past when there were no restrictions on venting gas to the atmosphere, an operator could simply bleed the accumulated gas from the tubing-casing annulus and suction the accumulated oil into a vacuum truck. However, regulatory, environmental and economic factors render this option illegal, undesirable and wasteful. The disclosed method and apparatus solves this problem and provides means by which the producer may be able to get the well back on production or reclaim oil and gas that is otherwise not available.

In the case of loaded up gas wells, there may be insufficient tubing head pressure to produce the loaded up well into the gas production system. The present invention provides a means for producing the well into a system with no back-pressure, separating the liquids from the gas phase, and compressing the gas to sufficient pressure for delivery into the gas production system.

In the case of new wells, it is often desirable to place the new well on production as soon as possible following completion to allow the well to clean-up or to obtain an initial well test. However, placing the well on production may be delayed if a flow line has not been installed between the wellhead and production facility. The disclosed invention provides a rapid means of linking the wellhead to the production system, and placing a well immediately into test.

In some cases the operator may desire to pump fluids down the tubing and take returns from the tubing-casing annulus, which, in normal operation, provides a conduit for gas production. For example, an operator may wish to pump scale inhibitor down the tubing and take returns on the tubing-casing annulus, without the returns going directly into the gas production system. It may be desirable to meter the returns. The disclosed method and apparatus allows the operator to achieve these objectives.

SUMMARY OF THE INVENTION

The present invention is directed to a method and apparatus which meets the needs identified above. The components of the disclosed apparatus may be mounted on a flatbed gooseneck trailer, thereby allowing the apparatus to be readily transportable to an oil well location for recovery of oil and gas, for the testing of the wells, or for other desired well operations. Alternatively, the components of the disclosed apparatus may be mounted on a crane-liftable skid unit where access to a well location is not practical by trailer.

The present invention comprises a portable flowline and measuring unit for delivering fluids from an oil well to a production facility, where the oil well has fluid conducting means for conducting fluids from the oil well to the portable flowline and measuring unit. The flowline and measuring unit comprises a flatbed trailer, the trailer having a platform, towing means and wheels, the platform comprising a top side and a bottom side, and wheels attached to the bottom side.

The top side of the platform comprises a production assembly. The production assembly includes components for reducing the pressure of the fluid stream, such as a choke valve hydraulically connected to the fluid conducting means. Inlet piping connects the choke valve to a two-phase separator. The two-phase separator comprises a gas outlet and a liquid outlet. The two-phase separator further comprises high liquid level detection means and low liquid level detection means. The high liquid level detection means produce a first signal when the liquid level in the two-phase separator reaches a first position. The low liquid level detection means produce a second signal when the liquid level in the two-phase separator reaches a second lower position.

Gas outlet piping is attached to the gas outlet, with the gas outlet piping hydraulically connected to gas discharge means, such as a separate gas production line, a flexible flowline contained on the unit, or a flare. A backpressure regulator is hydraulically connected to the gas outlet piping.

Liquid outlet piping is attached to the liquid outlet of the two-phase separator. A control dump valve is hydraulically connected to the liquid outlet piping. The control dump valve comprises a discharge outlet, and means for receiving the first signal and the second signal from the high liquid level detection means and the low liquid level detection means. The control dump valve also comprises means for actuating the valve, the dump valve opening upon receiving the first signal and closing upon receiving the second signal.

The unit further comprises a spooling drum and power means for rotating the spooling drum. A flexible flowline is wrapped around the spooling drum, where the flexible flowline has a first end and a second end. The discharge outlet of the dump valve is hydraulically connected to the first end of the flexible flowline. The second end of the flexible flowline has connecting means adapted to hydraulically connect to the production facility.

The unit may further comprise a liquid recirculating valve which is hydraulically connected to the liquid outlet piping. The recirculating valve is connected to a return line connected to the two-phase separator. The recirculating valve has means for receiving the first signal and the second signal and means for actuating the recirculating valve. The liquid recirculating valve closes when it receives the first signal and opens when it receives the second signal.

The unit may also comprise means for measuring the liquid flow rate and the gas flow rate.

Methods of using the disclosed apparatus are also disclosed. A newly drilled well having no permanent production line installed may be temporarily produced through the disclosed unit. This method comprises attaching the first end of a fluid-bearing conduit to the oil well. The second end of the fluid bearing conduit is connected to the portable flowline and gas measuring unit. The second end of the flexible flowline is attached to the production facility and the well is opened to allow reservoir fluids, including hydrocarbons, to flow through the portable flowline and gas measuring unit into the production facility. This method allows a newly drilled well to be produced and tested quickly, without having to await the installation of a permanent flowline or measurement facilities.

DETAILED DESCRIPTION OF THE EMBODIMENTS

The present invention and method comprises a portable flowline and measuring unit for delivering fluids from an oil well to a production facility. Conducting means, such as high pressure hose, are connected between the production line valve on the wellhead of the oil well to the disclosed apparatus.

Figure 1:
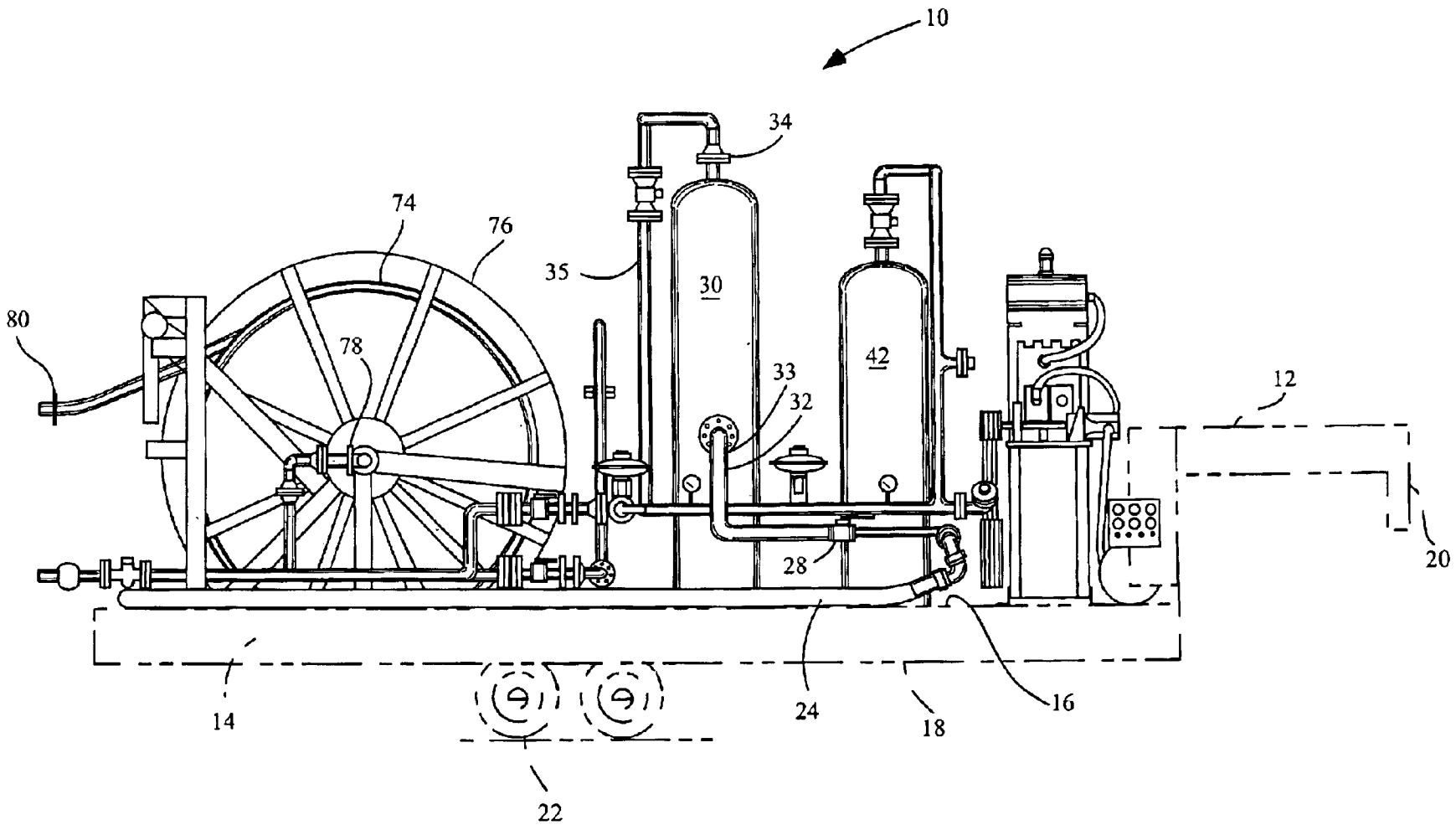
FIG. 1 is a side elevational view of the disclosed invention.

The portable flowline and measuring unit may utilize a flatbed trailer, as shown in FIG. 1, or a crane-liftable skid unit, which may be lifted into remote or offshore locations.

The portable flowline and measuring unit 10 is transported to the desired location and the high-pressure hose is connected between the unit and the wellhead or casing the well. The embodiment utilizing the flatbed trailer 12 comprises a platform 14 having a top side 16 and a bottom side 18, towing means 20 and wheels 22 attached to the bottom side 18. For convenience, high pressure hose 24 may be transported on the unit, the high pressure hose being one means for conducting fluids from the wellhead to the unit 10. Production assembly 15, which is depicted in greater detail in FIG. 2, is attached to the top side 16.

Figure 2:
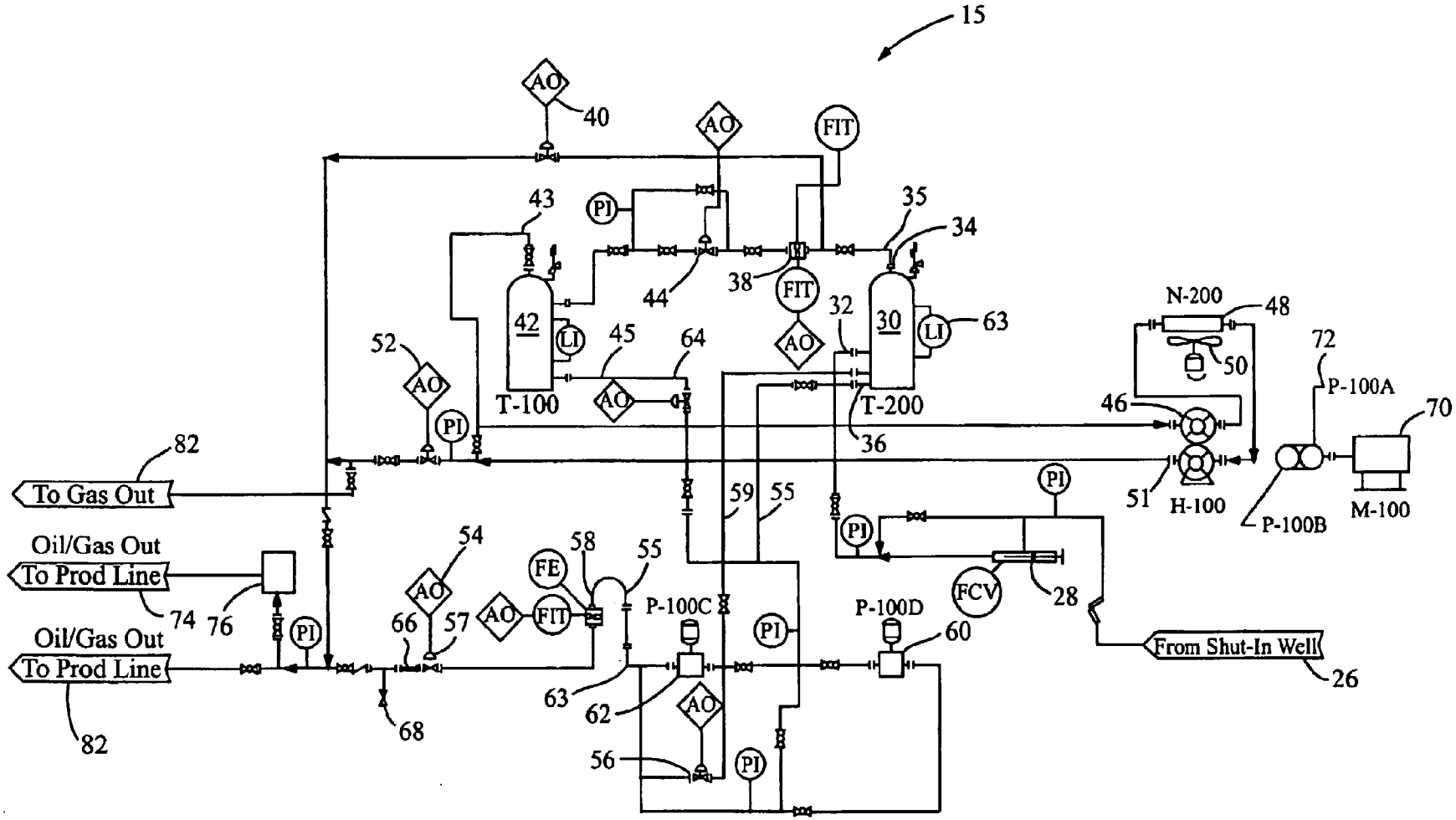
FIG. 2 is a simplified process flow diagram for the disclosed invention.

As further illustrated in the process flow diagram of FIG. 2, the equipment comprising the production assembly 15 may include processing equipment for separating, measuring, compressing, and pumping the hydrocarbons from the well. Fluids such as oil, gas and water from the well 26 pass through the high pressure hose 24 to the equipment of the production assembly 15. Fluids pass through a choke valve 28 and enter the two-phase separator 30 through inlet piping 32 connecting the separator and the choke valve 28. The inlet piping 32 is connected to two-phase separator 30 at an inlet 33. Choke valve 28 reduces the pressure down to a maximum working pressure within the acceptable rating of the two-phase separator 30. Two phase separator 30 comprises a gas outlet 34 and a liquid outlet 36.

Gas outlet 34 may installed at the top of separator 30. Gas flowing out through gas outlet 34 flows through gas outlet piping 35. Gas flowing out of the separator 30 may be measured through gas measurement means 38 connected to the gas outlet piping 35, such as a turbine meter or mass flow meter. A backpressure regulator 40 is hydraulically connected to gas outlet piping 35. The regulator 40 may be adjusted to increase or reduce the amount of working pressure on two-phase separator 30. Gas flowing through gas outlet piping 35 may be directed to various gas discharge means, which may comprise either a gas production line 82, flare, or commingled with a liquid phase going to a liquid production line, including flexible flowline 74. Alternatively, gas may be directed to knockout vessel 42 for further liquids removal, with pressure being reduced by pressure-reducing valve 44. Lower pressure gas exiting knockout vessel 42 from knockout gas outlet 43 enters the suction of compressor 46, which may be a two-stage compressor. Gas discharged from the first stage of the compressor may pass through heat exchanger 48 which is cooled by fan 50. Liquids from knockout vessel 42 exit the vessel through knockout liquid outlet 45, which is tied into liquid outlet piping 55.

Higher pressure gas exiting compressor 46 through high pressure outlet 51 is controlled by pressure regulator 52 for delivery into gas discharge means, which may comprise a gas production line, flare, or commingled with a liquid phase going to a liquid production line, including flexible flowline 74.

The liquid level of two-phase separator 30 is controlled by control dump valve 54 hydraulically connected to liquid outlet piping 55, which is attached to the liquid outlet 36. For convenience, the nomenclature "liquid outlet piping" generally refers to all liquid piping segments between the liquid outlet 36 and the point of liquid discharge from the unit 10, such as discharging liquids into flexible flowline 74. The two-phase separator further comprises high/low liquid level detection means 63, such as a magnetic type level indicator, such as that manufactured by K-TEK, with a pneumatic high and low level switch and a pneumatic relay. The high/low liquid level detection means 63 control the liquid level in two-phase separator 30. The high liquid level detection means 63 produces a first signal when the liquid level in separator 30 reaches a first position, i.e., a high level position. When the liquid level in separator 30 reaches the first position, a signal, such as the pneumatic signal produced by the K-TEK device, is sent to control dump valve 54, which has means for receiving the first signal. Upon receiving the first signal indicating a high liquid level, control dump valve 54 is actuated into the open position. Likewise, the low liquid level detection means produces a second signal when the liquid level in separator 30 reaches a second position, i.e., a low level position. Upon receiving the second signal indicating a low liquid level, control dump valve 54 is actuated into the closed position. The control dump valve 54 further comprises a discharge outlet 57, through which liquid flows when the valve is in the open position into further segments of the liquid outlet piping 55.

Liquid recirculating valve 56 may also be installed. Recirculating valve 56 also receives the first and second signal from the high liquid level detection means and low liquid level detection means and opens and closes upon receiving each signal. However, in contrast to the operation of the control valve 54, liquid recirculating valve 56 closes when it receives the first signal, indicating a high liquid level in separator 30, and recirculating valve 56 opens when it receives the second signal, indicating a low liquid level in separator 30. Recirculating valve 56 is connected to return line 59, which returns liquids back to separator 30.

If dump valve 54 is open, the oil volume may be measured by liquid measurement means 58, such as a turbine meter or mass flow meter attached to the liquid outlet piping 55. If the pressure of separator 30 is lower than the necessary pressure to overcome production line pressure, it will be necessary to increase the liquid pressure by engaging pumping means such as low volume pump 60 or high volume pump 62, which are hydraulically connected to the liquid outlet piping 55. The low volume pump 60 may be an in-line gear pump. The high volume pump 62 may be an in-line centrifugal pump. Pumped liquids are discharged through the pump outlet 63. Liquids discharged from knockout vessel 42 may also be blended into the liquid stream coming from separator 30. Control valve 64 allows liquids to be discharged into the liquid outlet piping after which the liquids may flow through liquid measurement means 58. The blended liquids may also be pumped by low volume pump 60 or high pressure pump 62.

Once liquids passes through liquid measurement means 58, the liquids may be mixed into a homogeneous state using an inline static mixer 66 located in the liquid outlet piping 55. A sample probe 68 may be installed just downstream in the liquid outlet piping 55 from static mixer 66 for manual or automatic sampling to determine any amount of water in the oil, or other liquid properties. Liquids are then transported off the unit 10 through either a separately configured production line, or through the flexible flowline 74.

After the oil and gas have been separated and measured, the fluid phases can either be transported separately to the production facility or the fluid streams can be recombined into a single flow line, which may be comprised of flex joints, rotating joints, or swivel joints. Alternatively, the individual fluid streams or the combined fluid streams can be transported to the production facility through flexible flowline 74 which is wrapped around spooling drum 76. The flexible flowline 74 has a first end 78, which is hydraulically connected to the discharge outlet 57 of control dump valve 54, and second end 80 which is adapted to hydraulically connect to the production facility or into an existing production line. The flexible flowline 74 is unspooled from the spooling drum 76 and connected to the desired production facility, or tied into an existing production line. Spooling drum 76 may hold approximately 3000 feet of flexible flowline 74. The spooling drum 76 is rotated by power means, which may include hydraulic power provided by high pressure hydraulic fluid as described below. The flexible flowline 74 is made of fiberglass and high composite resin material such as a Carilon™ lining, manufactured by Shell Chemical Company. As an alternative to the flexible flow line, where the distance to the production line or inlet to the surface facility is not very far, temporary flow lines may be set up.

The unit 10 includes its own power generation equipment for operating the different components. Prime mover 70, which may be a diesel or gas engine or electric motor, provides power to hydraulic pump 72. Hydraulic pump 72 provides pressurized hydraulic fluid for operating hydraulic motors on the compressor, fan, and for the other power requirements of the components of the trailer or skid, including the power means for the spooling drum 76.

The unit 10 may be transported by means other than the flatbed trailer shown in FIG. 1. The unit may also comprise a transportable skid unit, the skid unit comprising a top side and a bottom side. The transportable skid unit, in addition to the components described above which may be installed on the flatbed trailer, has lifting eyes attached to the top side. The lifting eyes allow the transportable skid unit to be picked by lifting means, such as a crane, and transported to remote locations, such as offshore or inland waters locations which are not accessible by conventional means.

It is to be appreciated that the necessary components of the unit 10 are dependent of several factors, including the production characteristics of the well to be produced, the location of the well, and the available facilities. For example, if the well has sufficient surface tubing pressure, no pumping or compression components are required on the unit. The first embodiment of the unit 10 therefore does not have pumping or compression equipment installed. It might also not be necessary, because of the availability of other measurement facilities, for gas measurement means 38 and liquid measurement means 58 to be included on the unit 10.

Methods of utilizing the disclosed apparatus are also disclosed. A newly drilled well having no permanent production line installed may be temporarily produced through the disclosed unit. This method comprises attaching the first end of a fluid-bearing conduit to the oil well. The second end of the fluid bearing conduit is connected to the portable flowline and gas measuring unit. The second end of the flexible flowline is attached to the production facility and the well is opened to allow reservoir fluids, including hydrocarbons, to flow through the portable flowline and gas measuring unit into the production facility. This method allows a newly drilled well to be produced and tested quickly, without having to await the installation of a permanent flowline or measurement facilities. If a well has sufficient wellhead pressure, the method requires no pumping or compression components. In contrast, for low wellhead pressures the method requires a unit 10 with the pumping and compression components.

A method for producing an idle well is also disclosed. Historically, the practice for working on idle wells has been to bleed off any accumulated hydrocarbons into the atmosphere before pulling the production tree for reworking, abandoning, or otherwise treating an idle well. This practice results in wasted hydrocarbon resources and the release of harmful substances into the atmosphere. The disclosed method provides for the containment, recovery and measurement of accumulated hydrocarbons. This method comprises the steps of attaching the first end of a fluid-bearing conduit to the oil well. The second end of the fluid bearing conduit is connected to the embodiment of the portable flowline and gas measuring unit having pumping means and gas compression means. The second end of the flexible flowline is attached to the production facility. The well is opened to allow accumulated reservoir fluids, including hydrocarbons, to flow to the portable flowline and gas measuring unit. Accumulated hydrocarbons in the gas state are compressed and discharged into gas discharge means such as the first end 78 of the flexible flowline 74 or into a gas production line 82. Accumulated hydrocarbons in the liquid state are pumped to sufficient pressure to deliver the liquids through the liquid measurement means 58, through the flexible flowline 74 or other liquid production line and into the liquid production facility.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed.

What is claimed is:

1. A portable flowline and measuring unit for delivering fluids from an oil well to a production facility, the oil well having fluid conducting means for conducting fluids from the oil well to the portable flowline and measuring unit, the flowline and measuring unit comprising:

a flatbed trailer comprising a platform, towing means and wheels, the platform comprising a top side and a bottom side, the wheels attached to the bottom side, a production assembly attached to the top side, the production assembly comprising:

(a) a choke valve hydraulically connected to the fluid conducting means;

(b) inlet piping connecting the choke valve to an inlet on a two-phase separator, the two-phase separator comprising a gas outlet and a liquid outlet, the two-phase separator further comprising high liquid level detection means and low liquid level detection means, said high liquid level detection means producing a first signal upon the liquid level in the two-phase separator reaching a first position, and said low liquid level detection means producing a second signal upon the liquid level in the two-phase separator reaching a second position;

(c) gas outlet piping attached to the gas outlet;

(d) liquid outlet piping attached to the liquid outlet;

(e) a backpressure regulator hydraulically connected to the gas outlet piping;

(f) a control dump valve hydraulically connected to the liquid outlet piping, the control dump valve comprising a discharge outlet, the dump valve further comprising means for receiving the first signal and the second signal and means for actuating the valve, the dump valve opening upon receiving the first signal and closing upon receiving the second signal;

(g) the gas outlet piping hydraulically connected to a knockout vessel;

(h) the gas outlet piping further comprising pressure reduction means between the two-phase separator and the knockout vessel;

(i) the knockout vessel further comprising a knockout gas outlet and a knockout liquid outlet;

(j) the knockout gas outlet connected to gas compression means, said gas compression means having a high pressure outlet, the high pressure outlet hydraulically connected to gas discharge means;

(k) the knockout liquid outlet hydraulically connected to the liquid outlet piping;

(l) a spooling drum;

(m) power means for rotating the spooling drum;

(n) a flexible flowline wrapped around the spooling drum, the flexible flowline having a first end and a second end;

(o) the discharge outlet of the dump valve hydraulically connected to the first end of the flexible flowline; and (p) the second end of the flexible flowline comprising connecting means adapted to hydraulically connect to the production facility.

2. The portable flowline and measuring unit of claim 1 further comprising a liquid recirculating valve hydraulically connected to the liquid outlet piping, the recirculating valve connected to a return line connected to the two-phase separator, the recirculating valve comprising means for receiving the first signal and the second signal and means for closing when the first signal is received and opening when the second signal is received.

3. The portable flowline and measuring unit of claim 1 further comprising gas measurement means attached to the gas outlet piping for measuring flow rate from the gas outlet.

4. The portable flowline and gas measuring unit of claim 1 further comprising liquid measurement means attached to the liquid outlet piping for measuring the liquid flow rate the liquid outlet.

5. The portable flowline and gas measuring unit of claim 1 further comprising a static mixer in the liquid outlet piping.

6. The portable flowline and gas measuring unit of claim 1 further comprising a sample probe in the liquid outlet piping.

7. A portable flowline and measuring unit for delivering fluids from an oil well to a production facility, the oil well having fluid conducting means for conducting fluids from the oil well to the portable flowline and measuring unit, the flowline and measuring unit comprising:

a flatbed trailer comprising a platform, towing means and wheels, the platform comprising atop side and a bottom side, the wheels attached to the bottom side, a production assembly attached to the top side, the production assembly comprising:

(a) a choke valve hydraulically connected to the fluid conducting means;

(b) inlet piping connecting the choke valve to an inlet on a two-phase separator, the two-phase separator comprising a gas outlet and a liquid outlet, the two-phase separator further comprising high liquid level detection means and low liquid level detection means, said high liquid level detection means producing a first signal upon the liquid level in the two-phase separator reaching a first position, and said low liquid level detection means producing a second signal upon the liquid level in the two-phase separator reaching a second position;

(c) gas outlet piping attached to the gas outlet;

(d) liquid outlet piping attached to the liquid outlet;

(e) a backpressure regulator hydraulically connected to the gas outlet piping;

(f) a control dump valve hydraulically connected to the liquid outlet piping, the control dump valve comprising a discharge outlet, the dump valve further comprising means for receiving the first signal and the second signal and means for actuating the valve, the dump valve opening upon receiving the first signal and closing upon receiving the second signal;

(g) the gas outlet piping hydraulically connected to a knockout vessel;

(h) the gas outlet piping further comprising pressure reduction means between the two-phase separator and the knockout vessel;

(i) the knockout vessel further comprising a knockout gas outlet and a knockout liquid outlet;

(j) the knockout gas outlet connected to gas compression means, said gas compression means having a high pressure outlet, the high pressure outlet hydraulically connected to gas discharge means;

(k) the knockout liquid outlet hydraulically connected to the liquid outlet piping;

(l) pumping means hydraulically connected to liquid outlet piping, said pumping means having a pump outlet;

(m) a spooling drum;

(n) power means for rotating the spooling drum;

(o) a flexible flowline wrapped around the spooling drum, the flexible flowline having a first end and a second end;

(p) the pump outlet of the pumping means hydraulically connected to the first end of the flexible flowline; and (q) the second end of the flexible flowline comprising connecting means adapted to hydraulically connect to the production facility.

8. The portable flowline and measuring unit of claim 7 further comprising a liquid recirculating valve hydraulically connected to the liquid outlet piping, the recirculating valve connected to a return line connected to the two-phase separator, the recirculating valve comprising means for receiving the first signal and the second signal and means for closing when the first signal is received and opening when the second signal is received.

9. The portable flowline and measuring unit of claim 7 further comprising gas measurement means attached to the gas outlet piping for measuring flow rate from the gas outlet.

10. The portable flowline and gas measuring unit of claim 7 further comprising liquid measurement means attached between the pump outlet and the first end of the flexible flowline for measuring the liquid flow rate from the liquid outlet.

11. The portable flowline and gas measuring unit of claim 7 further comprising a static attached between the pump outlet and the first end of the flexible flowline.

12. The portable flowline and gas measuring unit of claim 7 further comprising a sample probe attached between the pump outlet and the first end of the flexible flowline.

13. A portable flowline and measuring unit for delivering fluids from an oil well to a production facility, the oil well having fluid conducting means for conducting fluids from the oil well to the portable flowline and measuring unit, the flowline and measuring unit comprising:

a transportable skid unit, the skid unit comprising a top side and a bottom side, the top side comprising lifting eyes for connecting the skid unit to lifting means, and a production assembly, the production assembly comprising:

(a) a choke valve hydraulically connected to the fluid conducting means;

(b) inlet piping connecting the choke valve to an inlet on a two-phase separator, the two-phase separator comprising a gas outlet and a liquid outlet, the two-phase separator further comprising high liquid level detection means and low liquid level detection means, said high liquid level detection means producing a first signal upon the liquid level in the two-phase separator reaching a first position, and said low liquid level detection means producing a second signal upon the liquid level in the two-phase separator reaching a second position;

(c) gas outlet piping attached to the gas outlet;

(d) liquid outlet piping attached to the liquid outlet;

(e) a backpressure regulator hydraulically connected to the gas outlet piping;

(f) a control dump valve hydraulically connected to the liquid outlet piping, the control dump valve comprising a discharge outlet, the dump valve further comprising means for receiving the first signal and the second signal and means for actuating the valve, the dump valve opening upon receiving the first signal and closing upon receiving the second signal;

(g) the gas outlet piping hydraulically connected to a knockout vessel;

(h) the gas outlet piping further comprising pressure reduction means between the two-phase separator and the knockout vessel;

(i) the knockout vessel further comprising a knockout gas outlet and a knockout liquid outlet;

(j) the knockout gas outlet connected to gas compression means, said gas compression means having a high pressure outlet, the high pressure outlet hydraulically connected to gas discharge means;

(k) the knockout liquid outlet hydraulically connected to the liquid outlet piping;

(l) pumping means hydraulically connected to the liquid outlet piping, said pumping means having a pump outlet;

(m) a spooling drum;

(n) power means for rotating the spooling drum, (o) a flexible flowline wrapped around the spooling drum, the flexible flowline having a first end and a second end;

(p) the pump outlet of the pumping means hydraulically connected to the first end of the flexible flowline; and (q) the second end of the flexible flowline comprising connecting means adapted to hydraulically connect to the production facility.

14. The portable flowline and measuring unit of claim 13 further comprising a liquid recirculating valve hydraulically connected to the liquid outlet piping, the recirculating valve connected to a return line connected to the two-phase separator, the recirculating valve comprising means for receiving the first signal and the second signal and means for closing when the first signal is received and opening when the second signal is received.

15. The portable flowline and measuring unit of claim 13 further comprising gas measurement means attached to the gas outlet piping for measuring flow rate from the gas outlet.

16. The portable flowline and gas measuring unit of claim 13 further comprising liquid measurement means attached between the pump outlet and the first end of the flexible flowline for measuring the liquid flow rate from the liquid outlet.

17. The portable flowline and gas measuring unit of claim 13 further comprising a static mixer attached between the pump outlet and the first end of the flexible flowline.

18. The portable flowline and gas measuring unit of claim 13 further comprising a sample probe attached between the pump outlet and the first end of the flexible flowline.

19. Having an oil well without a permanent production line installed, a method of temporarily producing hydrocarbons from the oil well to a production facility comprising the steps of:

(a) attaching a first end of a fluid-bearing conduit to the oil well;

(b) connecting the second end of the fluid-bearing conduit to a portable flowline and measuring unit, the portable flowline and gas measuring unit comprising a flatbed trailer comprising a platform, towing means and wheels, the platform comprising a top side and a bottom side, the wheels attached to the bottom side, the, top side comprising a production assembly, the production assembly comprising:

(1) a choke valve hydraulically connected to the fluid conducting means;

(2) inlet piping connecting the choke valve to an inlet on a two-phase separator, the two-phase separator comprising a gas outlet and a liquid outlet, the two-phase separator further comprising high liquid level detection means and low liquid level detection means, said high liquid level detection means producing a first signal upon the liquid level in the two-phase separator reaching a first position, and said low liquid level detection means producing a second signal upon the liquid level in the two-phase separator reaching a second position;

(3) gas outlet piping attached to the gas outlet;

(4) liquid outlet piping attached to the liquid outlet;

(5) a backpressure regulator hydraulically connected to the gas outlet piping;

(6) a control dump valve hydraulically connected to the liquid outlet piping, the control dump valve comprising a discharge outlet, the dump valve further comprising means for receiving the first signal and the second signal and means for actuating the valve, the dump valve opening upon receiving the first signal and closing upon receiving the second signal;

(7) the gas outlet piping hydraulically connected to a knockout vessel;

(8) the gas outlet piping further comprising pressure reduction means between the two-phase separator and the knockout vessel;

(9) the knockout vessel further comprising a knockout gas outlet and a knockout liquid outlet;

(10) the knockout gas outlet connected to gas compression means, said gas compression means having a high pressure outlet, the high pressure outlet hydraulically connected to gas discharge means;

(11) the knockout liquid outlet hydraulically connected to the liquid outlet piping;

(12) pumping means hydraulically connected to the liquid outlet piping, said pumping means having a pump outlet;

(13) a spooling drum;

(14) power means for rotating the spooling drum;

(15) a flexible flowline wrapped around the spooling drum, the flexible flowline having a first end and a second end;

(16) the pump outlet of the pumping means hydraulically connected to the first end of the flexible flowline;

(17) the second end of the flexible flowline comprising connecting means adapted to hydraulically connect to the production facility;

(c) attaching the second end of the flexible flowline to the production facility; and (d) producing the oil well through the portable flowline and gas measuring unit into the production facility.

20. The method of claim 19 wherein the gas discharge means comprises the first end of the flexible flowline.

21. The method of claim 19 wherein the gas discharge means comprises a gas production line.

22. The method of claim 19 wherein the gas discharge means comprises a flare.

23. Having an oil well with a wellhead but without a permanent production line installed, a method of recovering hydrocarbons accumulated at the wellhead and producing the hydrocarbons to a production facility comprising the steps of:

(a) attaching a first end of a fluid-bearing conduit to the oil well;

(b) connecting the second end of the fluid-bearing conduit to a portable flowline and measuring unit, the portable flowline and gas measuring unit comprising a flatbed trailer comprising a platform, towing means and wheels, the platform comprising a top side and a bottom side, the wheels attached to the bottom side, the top side comprising a production assembly, the production assembly comprising:

(1) a choke valve hydraulically connected to the fluid conducting means;

(2) inlet piping connecting the choke valve to an inlet on a two-phase separator, the two-phase separator comprising a gas outlet and a liquid outlet, the two-phase separator further comprising high liquid level detection means and low liquid level detection means, said high liquid level detection means producing a first signal upon the liquid level in the two-phase separator reaching a first position, and said low liquid level detection means producing a second signal upon the liquid level in the two-phase separator reaching a second position;

(3) gas outlet piping attached to the gas outlet, the gas outlet piping hydraulically connected to gas discharge means;

(4) liquid outlet piping attached to the liquid outlet;

(5) a backpressure regulator hydraulically connected to the gas outlet piping;

(6) the gas outlet piping hydraulically connected to a knockout vessel;

(7) the gas outlet piping further comprising pressure reduction means between the two-phase separator and the knockout vessel;

(8) the knockout vessel further comprising a knockout gas outlet and a knockout liquid outlet;

(9) the knockout gas outlet connected to gas compression means, said gas compression means having a high pressure outlet, the high pressure outlet hydraulically connected to gas discharge means;

(10) the knockout liquid outlet hydraulically connected to the liquid outlet piping;

(11) a control dump valve hydraulically connected to the liquid outlet piping, the control dump valve comprising a discharge outlet, the dump valve further comprising means for receiving the first signal and the second signal and means for actuating the valve, the dump valve opening upon receiving the first signal and closing upon receiving the second signal;

(12) gas measurement means attached to the gas outlet piping for measuring flow rate from the gas outlet;

(13) pumping means hydraulically connected to the liquid outlet piping, said pumping means having a pump outlet;

(14) a spooling drum;

(15) power means for rotating the spooling drum;

(16) a flexible flowline wrapped around the spooling drum, the flexible flowline having a first end and a second end;

(17) the pump outlet hydraulically connected to the first end of the flexible flowline;

(18) the second end of the flexible flowline comprising connecting means adapted to hydraulically connect to the production facility;

(c) attaching the second end of the flexible flowline to the production facility; and (d) opening the wellhead and allowing accumulated hydrocarbons to flow from the oil well to the portable flowline and gas measuring unit;

(e) compressing any accumulated hydrocarbons in the gas state with the compression means to deliver the hydrocarbons to the production facility; and (f) pumping any accumulated hydrocarbons in the liquid state with the pumping means to deliver the hydrocarbons to the production facility.

24. The method of claim 23 wherein the gas discharge means comprises the first end of the flexible flowline.

25. The method of claim 23 wherein the gas discharge means comprises a gas production line.

* * * * *